US005683626A

United States Patent [19]

Sartori et al.

[11] Patent Number: 5,683,626

[45] Date of Patent: Nov. 4, 1997

[54] PROCESS FOR NEUTRALIZATION OF PETROLEUM ACIDS

[75] Inventors: Guido Sartori, Annandale; David W. Savage, Lebanon; Bruce H. Ballinger, Bloomsbury, all of N.J.

[73] Assignee: Exxon Research and Engineering Company, Florham Park, N.J.

[21] Appl. No.: 519,555

[22] Filed: Aug. 25, 1995

[51] Int. Cl.[6] ..... C09K 3/00; C09K 15/00

[52] U.S. Cl. ..... 252/389.62; 252/387; 208/47; 208/48 AA; 507/939

[58] Field of Search ..... 507/939; 208/47, 208/48 AA; 252/389.62, 387

[56] References Cited

U.S. PATENT DOCUMENTS

| | | | |
|---|---|---|---|
| 2,770,580 | 11/1956 | Honeycutt et al. | 196/36 |
| 2,789,081 | 4/1957 | Mills et al. | 196/36 |
| 2,795,532 | 6/1957 | Honeycutt | 196/36 |
| 3,766,053 | 10/1973 | Seffens | 208/47 |
| 4,033,860 | 7/1977 | Carlson | 208/206 |
| 4,199,440 | 4/1980 | Verachtert | 208/230 |
| 4,300,995 | 11/1981 | Liotta | 208/8 |
| 4,647,366 | 3/1987 | Edmondson | 208/47 |
| 5,182,013 | 1/1993 | Petersen et al. | 208/348 |

FOREIGN PATENT DOCUMENTS

| | | | |
|---|---|---|---|
| 1786060 | 7/1993 | U.S.S.R. . | |
| 469573 | 7/1937 | United Kingdom . | |
| 1566052 | 4/1980 | United Kingdom | C10G 27/06 |

OTHER PUBLICATIONS

Camp et al., "Neutralization as a Means of Controlling Corrosion of Refinery Equipment," 5th Ann. Conf. of Corros. Eng. (4/11–14), vol. 6, pp. 39–44 (Feb., 1950).

Chemical Abstracts, 72, 113446, "Treatment of Diesel Fuel with Chemical Sorbent," Alekperova et al., (1968).

Kalichevsky and Kobe, *Petroleum Refinery With Chemicals*, Ch. 4, Elsevier Publishing Company, 1956.

*Primary Examiner*—Sharon A. Gibson
*Assistant Examiner*—Deanna Baxam
*Attorney, Agent, or Firm*—Linda M. Scuorzo

[57] ABSTRACT

The invention relates to a process for treating naphthenic acid—containing whole crudes or fractions thereof to reduce or eliminate their acidity by contacting the acidic whole crude or fraction at a temperature of from about 50° C. to 350° C. with a neutralizing amount of tetraalkylammonium hydroxide, preferably tetramethyl-ammonium hydroxide. The process has the additional benefits of reducing materials handling problems associated with treating oils using liquid solvents and in reducing emulsion formation.

7 Claims, No Drawings

PROCESS FOR NEUTRALIZATION OF PETROLEUM ACIDS

FIELD OF THE INVENTION

The present invention relates to a process for neutralizing petroleum acids.

BACKGROUND OF THE INVENTION

Whole crudes with high organic acid content such as those containing naphthenic acids are corrosive to the equipment used to extract, transport and process the crude.

Efforts to minimize naphthenic acid corrosion have included a number of approaches. U.S. Pat. No. 5,182,013 refers to such recognized approaches as blending of higher naphthenic acid content oil with low naphthenic acid content oil. Additionally, a variety of attempts have been made to address the problem by using corrosion inhibitors for the metal surfaces of equipment exposed to the acids, or by neutralizing and removing the acids from the oil. Examples of these technologies include treatment of metal surfaces with corrosion inhibitors such as polysulfides (U.S. Pat. No. 5,182,013) or oil soluble reaction products of an alkynediol and a polyalkene polyamine (U.S. Pat. No. 4,647,366), or by treatment of a liquid hydrocarbon with a dilute aqueous alkaline solution, specifically dilute aqueous NaOH or KOH (U.S. Pat. No. 4,199,440). U.S. Pat. No. 4,199,440 notes, however, that a problem arises with the use of aqueous solutions that contain higher concentrations of base. These solutions form emulsions with the oil, necessitating use of only dilute aqueous base solutions. U.S. Pat. No. 4,300,995 discloses the treatment of carbonous material particularly coal and its products, heavy oils, vacuum gas oil petroleum resids having acidic functionalities with a dilute quaternary base such as tetramethylammonium hydroxide in a liquid (alcohol or water). IR data of the untreated crude show a peak at 3300–3600 $cm^{-1}$ corresponding to a phenolic hydroxide (Example 6). The $C^{13}$ NMR spectrum of O-methylated crude shows a signal at 55 ppm corresponding to a methyl phenoxide (Examples 3 and 4). This patent was aimed at improving yields and physical characteristics of the products and did not address the question of acidity reduction.

While these processes have achieved varying degrees of success there is a continuing need to develop more efficient methods for treating these acidic crudes.

SUMMARY OF THE INVENTION

A process for decreasing the acidity of an acidic crude oil comprising: contacting an organic acid containing crude oil at an elevated temperature with an effective amount of tetraalkylammonium hydroxide, preferably solid, to produce a treated crude oil having a reduced acidity.

The present invention may suitably comprise, consist or consist essentially of the elements disclosed and may be practiced in the absence of an element not disclosed.

DETAILED DESCRIPTION OF THE INVENTION

Some crude oils contain organic acids that contribute to corrosion or fouling of refinery equipment and that are difficult to separate from the processed oil. These organic acids generally fall within the category of naphthenic and other organic acids. Naphthenic acids alone or in combination with other organic acids can cause corrosion at temperatures ranging from about 65° C. (150° F.) to 420° C. (790° F.).

The crudes that may be used are any naphthenic acid-containing crude oils that are liquid or liquefiable at the temperatures at which the present invention is carried out. As used herein the term whole crudes means unrefined, non-distilled crudes.

Applicants have discovered that acidic crude oils, i.e., those containing naphthenic acids, may be treated by contacting the crude with an effective amount of tetraalkylammonium hydroxide, preferably tetramethylammonium hydroxide, and preferably in solid form, to produce a treated or final crude having a reduced or essential absence of acidity. The naphthenic acids may be present either alone or in combination with other organic acids, such as phenols. The acidic crudes are preferably whole crudes. However, acidic fractions of whole crudes also may be treated. An additional benefit of the treatment process is the absence or substantial absence of emulsion formation. Emulsion formation is undesirable and a particular problem that is encountered during treatment of naphthenic acid-containing crudes with aqueous bases. The formation of a crude oil-aqueous emulsion tends to interfere with the efficient separation of the whole crude oil and water phases and thus with recovery of the whole crude oil. Thus, in addition to their corrosivity such acids must be removed from the crude oil due to their tendency to encourage emulsion formation during processing. The process of the present invention when carried out in the essential absence of added solvent (i.e., water or alcohol) for the tetraalkylammonium hydroxide, reduces the volume of liquid, particularly solvent, that must be handled.

The contacting is typically carried out at an elevated temperature sufficient to reflux the solution. Typically, this is from about 50° C. to 350° C., preferably 100° C. to 170° C., more preferably 120° to 150° C. Desirably this results in esterification of the naphthenic acids in the crude oil.

Tetraalkylammonium hydroxides may be purchased commercially or synthesized using known procedures. Tetramethylammonium hydroxide, for example, typically occurs in solid form as crystals of the pentahydrate, represented by the formula $(CH_3)_4NOH.5H_2O$. The tetraalkylammonium hydroxide is added to the acidic crude in an amount effective to produce a neutralized final crude oil. Typically, it is added in a molar ratio of tetraalkylammonium hydroxide to total acid of from 1:1 to about 10:1, preferably of from 2:1 to 1:1. The addition of smaller amounts of tetraalkylammonium hydroxide may result in an incomplete neutralization of the starting crude. Each alkyl chain typically contains up to about four carbon atoms.

Reaction times depend on the nature of the crude to be treated, its acid content, and the amount and type of tetraalkylammonium hydroxide added, but typically may be carried out for from about 1 hour to about 20 hours to produce a product having a decrease in naphthenic acid and other acid content.

The concentration of acid in the crude oil is typically expressed as an acid neutralization number or acid number, which is the number of milligrams of KOH required to neutralize the acidity of one gram of oil. Included are acidic crudes wherein the oil has a neutralization number of 0.5 to 10 mg KOH/g. It may be determined according to ASTM D-664. Typically, the decrease in acid content may be determined by a decrease in the neutralization number or in the intensity of the carboxyl band in the infrared spectrum at about 1708 $cm^{-1}$. Whole crude oils with acid numbers of about 1.0 and lower are considered to be of moderate to low corrosivity. Crudes with acid numbers greater than 1.5 are considered corrosive. Acidic crudes having free carboxyl groups may be effectively treated using the process of the present invention.

While not wishing to be bound by any theory it is believed that the reaction takes place by neutralization of the acid groups on the naphthenic acid to produce an aliphatic ester as follows:

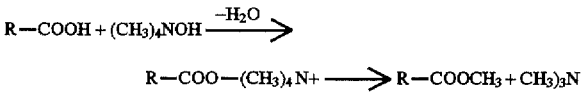

Regeneration of the tetraalkylammonium hydroxide, e.g., tetramethyl-ammonium hydroxide, can be carded out in a number of ways, ideally:

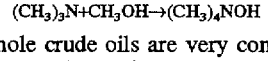

Whole crude oils are very complex mixtures in which a large number of competing reactions may occur. Unexpectedly, the reaction occurs completely although the acid is dilute in comparison to the large excess of crude and other reactive species typically present.

The process of the present invention has utility in processes in which inhibiting or controlling liquid phase corrosion, e.g., of metal surfaces, is desired. More generally, the present invention may be used in applications in which a reduction in the acidity, typically, as evidenced by a decrease in the neutralization number of the acidic whole crude or a decrease in intensity of the carboxyl band in the infrared spectrum at about 1708 $cm^{-1}$ of the treated (neutralized) crude, would be beneficial and in which oil-aqueous emulsion formation and large solvent volumes are not desirable. The present invention also provides a method for controlling emulsion formation in acidic crudes, by treating a major contributing component of such emulsions, naphthenic and similar organic acids, and by reducing the attendant handling and processing problems.

The present invention may be demonstrated with reference to the following non-limiting examples.

EXAMPLE 1

The reaction apparatus was a flask equipped with a stirrer, Dean-Stark trap and reflux condenser, immersed in an oil bath. 50 g of San Juaquim Valley whole crude, having a neutralization number of 4.17 mg KOH/g, and 6.5 g of tetramethylammonium hydroxide pentahydrate were added to the flask. The oil bath temperature was gradually increased until water began to collect in the Dean-Stark trap. The temperature of the oil bath was brought to 140° C. and held for 16 hours. After cooling, the flask content was analyzed and found to have a neutralization number of 0.12 mg KOH/g.

EXAMPLE 2

The reaction apparatus was the same as in Example 1. 50 g of San Juaquim Valley acid whole crude, with neutralization number 4.17 mg KOH/g and 0.68 g of tetramethylammonium hydroxide pentahydrate were put into the flask. The oil bath temperature was gradually increased, until no more water collected in the Dean-Stark trap. The final temperature was 140° C. After cooling, the flask content had a neutralization number of 0.55 mg KOH/g.

The infrared spectrum of untreated San Juaquim Valley crude showed a band at 1708 $cm^{-1}$, corresponding to free carboxyl groups. After treatment with tetramethylammonium hydroxide, the band at 1708 $cm^{-1}$ became less intense and a new band appeared at 1742 $cm^{-1}$, indicating presence of ester groups.

EXAMPLE 3

The reaction apparatus was the same as in Example 1. 50 g of Bolobo 2/4 crude, with a neutralization number of 8.2 mg KOH/g and 1.8 g of a 38 weight % solution of tetramethylammonium hydroxide in water were put into the flask. The oil bath temperature was gradually increased until no more water condensed in the Dean-Stark trap. After cooling, the flask content was analyzed and found to have a neutralization number of 0.21 mg KOH/g.

What is claimed is:

1. A process for decreasing the acidity of a naphthenic acid containing crude oil comprising: contacting a naphthenic acid containing crude oil at an elevated temperature of from about 50° C. to 350° C. with an effective amount of solid tetraalkylammonium hydroxide in a molar ratio to total acid of from about 1:1 to 10:1 to produce a treated crude oil having a reduced acidity in the substantial absence of emulsion formation.

2. The process of claim 1 wherein the oil is an acidic whole crude oil.

3. The process of claim 1 wherein the oil is an acidic crude fraction.

4. The process of claim 1, wherein the tetraalkylammonium hydroxide is tetramethylammonium hydroxide.

5. The process of claim 1 wherein the acidic crude oil has a neutralization number of from about 0.5 to 10 mg KOH/g.

6. The process of claim 1 wherein contacting produces a treated crude containing aliphatic esters of naphthenic acids.

7. The process of claim 1 wherein the reduction in acidity of the treated crude oil is produced in the absence of emulsion formation.

* * * * *